US010302371B2

(12) United States Patent
Kadijk et al.

(10) Patent No.: US 10,302,371 B2
(45) Date of Patent: May 28, 2019

(54) LOW WEIGHT TUBE FIN HEAT SINK

(71) Applicant: SIGNIFY HOLDING B.V., Eindhoven (NL)

(72) Inventors: Simon Eme Kadijk, Eindhoven (NL); Mohammad Mirsadeghi, Eindhoven (NL); Dirk Gehrels, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 27 days.

(21) Appl. No.: 15/519,694

(22) PCT Filed: Oct. 13, 2015

(86) PCT No.: PCT/EP2015/073604
§ 371 (c)(1),
(2) Date: Apr. 17, 2017

(87) PCT Pub. No.: WO2016/062577
PCT Pub. Date: Apr. 28, 2016

(65) Prior Publication Data

US 2017/0248379 A1 Aug. 31, 2017

(30) Foreign Application Priority Data

Oct. 20, 2014 (EP) ..... 14189461

(51) Int. Cl.
*F28F 3/02* (2006.01)
*F21V 29/80* (2015.01)
*F21V 29/81* (2015.01)

(52) U.S. Cl.
CPC ..... *F28F 3/022* (2013.01); *F21V 29/80* (2015.01); *F21V 29/81* (2015.01)

(58) Field of Classification Search
CPC ..... F28F 3/022; F21V 29/80; F21V 29/81; F21V 29/00; F28D 2021/0028;
(Continued)

(56) References Cited

U.S. PATENT DOCUMENTS 5,276,585 A * 1/1994 Smithers ..... H01L 23/3677 165/185
5,351,748 A * 10/1994 Dagan ..... F28F 3/022 165/185
(Continued)

FOREIGN PATENT DOCUMENTS

CN 201550387 U 8/2010
CN 202253522 U 5/2012
(Continued)

*Primary Examiner* — Justin M Jonaitis
(74) *Attorney, Agent, or Firm* — Akarsh P. Belagodu

(57) ABSTRACT

The invention provides a lighting device comprising a light source and a heat sink (200). The heat sink (200) is configured to dissipate thermal energy from the light source when in operation. The heat sink comprises a plurality of pin-shaped fins (210) and a support (220), wherein each fin (210) has a fin height (h) relative to the support (220), a bottom part (213) associated with the support (220) and a top part (214), a cross-section having a first width (d1) and a second width (d2) having a ratio d1/d2 selected from the range of 1.2-10, and a first width axis, wherein the first width axes of the pin-shaped fins (210) are arranged parallel, and wherein the pin-shaped fins (210) are hollow over at least part of their fin height (h).

12 Claims, 5 Drawing Sheets

(58) Field of Classification Search
CPC . F28D 2021/0029; H01L 23/40; H01L 23/46; H01L 23/467; F21S 41/17; F21S 45/40; H01J 2237/0492; H01J 2237/103
USPC ..... 165/80.3; 362/264, 373
See application file for complete search history.

(56) References Cited

U.S. PATENT DOCUMENTS 5,464,054 A * 11/1995 Hinshaw ..... H01L 23/4093 165/185
5,499,450 A * 3/1996 Jacoby ..... F28F 3/022 165/185
5,726,495 A * 3/1998 Aihara ..... H01L 21/4878 165/80.3
6,771,508 B1 * 8/2004 Ghosh ..... F28F 3/022 165/185
8,018,720 B2 * 9/2011 Campbell ..... F28D 15/0266 165/104.33
8,362,677 B1 * 1/2013 Morejon ..... F21V 29/004 313/46
2003/0221814 A1 * 12/2003 Kamath ..... F28F 3/022 165/80.3
2007/0091565 A1 * 4/2007 Malone ..... H05K 7/20145 361/695
2008/0066888 A1 * 3/2008 Tong ..... H01L 23/3677 165/80.3
2011/0157872 A1 6/2011 Chu
2012/0199336 A1 8/2012 Hsu
2013/0220587 A1 * 8/2013 Tamura ..... F28F 3/02 165/185
2014/0146534 A1 5/2014 Wang
2014/0146544 A1 5/2014 Gebhard et al.

FOREIGN PATENT DOCUMENTS

CN 203036595 U 7/2013
DE 20216065 U1 4/2003
JP 201116570 A 8/2011
KR 20120055718 A 5/2012
WO WO2010118183 A2 10/2010

* cited by examiner

LOW WEIGHT TUBE FIN HEAT SINK

CROSS-REFERENCE TO PRIOR APPLICATIONS

This application is the U.S. National Phase application under 35 U.S.C. § 371 of International Application No. PCT/EP2015/073604, filed on Oct. 13, 2015, which claims the benefit of European Patent Application No. 14189461.8, filed on Oct. 20, 2014. These applications are hereby incorporated by reference herein.

FIELD OF THE INVENTION

The invention relates to a lighting device including a heat sink. The invention further relates to a method of assembling a device, such as such lighting device. Yet, the invention also relates to the heat sink per se.

BACKGROUND OF THE INVENTION

The use of heat sinks for lighting applications is known in the art. US2014146544, for instance, describes a LED optical light engine spotlight which can accommodate a variable number of light-emitting diodes (LEDs). An optical projection lens mounted in front of the LEDs merges the separate LED beams into a single beam, similar to the single beam provided by a halogen light and reflector. A heat sink provides convection cooling up to approximately 100° F. An optional fan provides additional heat dissipation for more extreme conditions. An optional accessory lens provides additional capabilities, including flood lenses, colored lenses and rock guards, for example. The depicted device can be hard wired or wireless. The depicted device can be adapted to many base units and/or pan and tilt platforms.

SUMMARY OF THE INVENTION

In some LED lighting applications the weight of the total lighting solution is a critical factor. With the current efficacies of the lighting systems a lot of heat needs to be removed and a lot of heat sink fin area is required for that. The weight of the heat sinks can take more than 50% of the total weight (of the system or device). Weight reduction of the cooling system is essential to come to an acceptable solution for application. For instance, in outdoor professional applications big heat sinks are used for cooling of so-called floodlights. Typically such systems weigh around 25 kg, of which the heat sinks take 60%. Reduction to thin fins appears to be of interest but this may lead to dimensions which are very hard to achieve with affordable technologies. Moreover, thin ribs of the heat sink appear to be more vulnerable to deformation and damage, especially when used in outdoor applications.

Hence, it is an aspect of the invention to provide an alternative device, especially a lighting device, with a heat sink, which preferably further at least partly obviates one or more of above-described drawbacks. It is also an aspect of the invention to provide an alternative heat sink which preferably further at least partly obviates one or more of above-described drawbacks. Further, it is an aspect of the invention to provide an alternative method of assembling such device (and heat sink).

It appeared that especially hollow pins can lead to a low weight heat sink while nevertheless still providing (very) good heat dissipation. (Hollow) pin fin structures in an air flow field lead to a high heat transfer coefficient which requires less area and less volume of material for the same thermal performance. However, air flow obstruction by the tubular structures may be a limiting factor in the thermal performance. The air flow should be sufficiently high to transfer all heat to the outside of the heat sink. In order to have a maximum efficient solution, it appeared that the cross sectional shape of the tubes should be non-axisymmetric and especially aligned with the expected air flow direction. By that a low hydraulic resistance of the heat sink as a total can be obtained.

Hence, the proposed solution in this invention is to use thin walled tubes attached to a base plate (herein also indicated as "plate" or "support") instead of the usual fins on a base plate. The hollow tubes enable a stiff and low weight structure at the same time. The tubes may have low weight, such as due to low (fin) wall thickness and also a high bending and buckling stiffness due to the tubular shape. The internal channel may in embodiments have no substantial thermal function. Relative to fin heat sinks, the pin-shaped fins of the invention have a considerable cross sectional size. Hence, herein especially the tubes are non-axisymmetric in cross section, and are aligned with the expected air flow direction. In particular, an oval shape aligned with the air flow direction is combining a lot of area while allowing a high air flow through the heat sink.

Hence, in a first aspect the invention provides a lighting device comprising a light source and a heat sink, wherein the heat sink is configured to dissipate thermal energy from the light source when (the light source is) in operation, wherein the heat sink comprises a plurality of pin-shaped fins (herein further also indicated as "fins") and a support, wherein each fin has a fin height (h) relative to the support, a bottom part, associated with the support, and a top part, a cross-section having a first width (d1) and a second width (d2), especially having a ratio d1/d2 selected from the range of 1.2-15, especially 2-10, and a first width axis, wherein the first width axes of the pin-shaped fins are especially arranged parallel, and wherein especially the pin-shaped fins are hollow over at least part of their fin height (h), wherein each pin-shaped fin (210) comprises a fin wall (215) with the fin wall (215) defining a cavity (216) within the pin-shaped fin (210) having a cavity height (h2), wherein the cavity (216) has a cavity cross-section (217) with a cavity cross-sectional area (218), wherein over at least part of the cavity height (h2) the cavity cross-sectional area (218) reduces in a direction from the top part (214) to the bottom part (213).

In yet a further aspect, the invention also provides such heat sink per se, i.e. a heat sink comprising a plurality of pin-shaped fins and a support, in particular for a lighting device (such as further described herein), wherein each fin has a fin height (h) relative to the support, a bottom part (i.e. the part directed to support) associated with the support and a top part (i.e. the part most remote from the support), a cross-section having a first width (d1) and a second width (d2), especially having a ratio d1/d2 selected from the range of 1.2-15, especially 1.2-10, and a first width axis, wherein the first width axes of the pin-shaped fins are especially arranged parallel, and wherein especially the pin-shaped fins are hollow over at least part of their fin height (h), wherein each pin-shaped fin (210) comprises a fin wall (215) with the fin wall (215) defining a cavity (216) within the pin-shaped fin (210) having a cavity height (h2), wherein the cavity (216) has a cavity cross-section (217) with a cavity cross-sectional area (218), wherein over at least part of the cavity height (h2) the cavity cross-sectional area (218) reduces in a direction from the top part (214) to the bottom part (213). More in general, the invention also provides a device comprising a heat generating functional element (herein further indicated as "functional element"), such as a light source, and such heat sink, wherein the heat sink is especially configured to dissipate thermal energy from the heat generating functional element when (the heat generating functional element is) in operation. The invention will be further elucidated below, especially with reference to a device having a lighting functionality.

Further, such cavity may in embodiments not necessarily have the same width(s) over the entire length of the cavity (i.e. the wall(s) of the pin-shaped fin may vary in thickness over the height). In line with this, the cavity is larger closer to the top part and smaller closer to the bottom part. This may add to the strength of the pin-shaped fin, which may especially be of relevance for longer fins.

It appears that such heat sink may have the same dissipation properties as conventional heat sinks, but at a much lower weight. In other words, at the same weight, much better thermal energy dissipation properties are obtained. This weight reduction may (thus) also be used to reduce the size of the heat sink while still maintaining suitable heat sink functionality. Further, such heat sink may also be used to improve the efficiency of the device, as in general efficiency decreases with increasing temperature. With the present heat sink, the functional element in a device, such as a light source, may be cooled better, leading to a more efficient operating of the device (such as the light source). Here, the term efficiency may especially relate to system efficacy (in 1 m/W) or system efficiency (in optical power/total power). For non-lighting device, other indications of efficiency may be used.

The heat generating functional element, as indicated above, can be any element that is used for its function and thereby generates thermal energy, such as especially a light source that generates heat when providing light, but also telecommunication equipment for e.g. mobile networks, (especially) electronics that use multiple power transistors, automotive applications, etc. The light source can be any light source, including a halogen lamp, a high pressure lamp, a metal-halide lamp, a sodium lamp, a LED lamp, etc. In a specific embodiment, the light source comprises a solid state LED light source (such as a LED or laser diode). The term "light source" may also relate to a plurality of light sources, such as 2-20 (solid state) LED light sources. However, the light source may also include much more LED light sources. Hence, the term LED may also refer to a plurality of LEDs.

The lighting device described herein may especially comprise a floodlight. Floodlights especially are broad-beamed, high-intensity artificial lights. They are often used to illuminate outdoor playing fields while an outdoor sports event is being held during low-light conditions or as a stage lighting instrument in live performances such as concerts and plays. Floodlights typically provide luminous efficacies of at least 70 lumen/watt, such as at least 100 lumen/watt. Floodlights can be entirely LED based.

Heat sinks are known in the art. A heat sink can be defined as a passive heat exchanger that cools a device by dissipating heat into the surrounding medium. A heat sink is especially designed to maximize its surface area in contact with the cooling medium surrounding it, such as the air. The heat sink and the functional element may be in physical contact with each other. However, alternatively or additionally, there may be a thermally conductive medium in between, such as a thermal adhesive or thermal grease. Further, alternatively or additionally, a heat pipe may be configured between the functional element and the heat sink. Such heat pipe may be used to transfer heat from the functional element to the heat sink, and the heat sink may be used to dissipate the thermal energy to the environment. Hence, the heat sink is configured to dissipate thermal energy from the functional element, especially the light source (when in operation).

The heat sink comprises a support and a plurality of pin-shaped fins. The fins are associated with the support. For instance, the fins may be welded to the support, may be screwed to the support, may be engaged by the support, etc. Optionally, the support and the fins are a single unit, such as obtainable by using a mold. Methods to produce heat sinks are known in the art. For instance, the fins may be provided by extrusion, die casting, deep drawing or metal stamping, etc. Hence, the term "associated with" may refer to any technically possible connection between the fins and the support.

As indicated above, the pin-shaped fins have a top part and a bottom part. The part indicated as bottom part is especially associated with the support. The fins may be open at both sides, or closed at one side, or closed at both sides (see further below). The fins have a fin height, which is in general substantially larger than a fin width (see further also below). The fins may have heights of at least 0.5 cm, such as at least 1 cm or at least 2 cm, but fins having height of at least 10 cm, even at least 20 cm, or yet even at least 50 cm, may also be possible. Even fins equal to or larger than 100 cm (height) may be possible. Hence, the pin-shaped fins may have a height in the range of 0.5-150 cm, especially 0.5-100 cm. The fins of the heat sink will in general have equal heights, though a distribution of different heights may also be possible. The pin-shaped fins may have (fin) wall thicknesses in the range of 0.1-20 mm, especially in the range of 0.1-10 mm. The thickness may depend upon the height of the fins, i.e. higher fins will in general have thicker walls. The wall thickness is in general substantially smaller than the height or the width(s) of the fin. The support may especially have a thickness in the range of 0.5-50 mm, such as in the range of 2-10 mm.

As indicated above, the pins are hollow, i.e. at least over part of the height of the fins the fins are hollow. In general, over substantially the entire height the fins will be hollow. For instance, over at least 50%, even more especially over at least 90%, such as 100%, of the height of the fin, the fin is hollow. For instance, such fins may be obtained with metal stamping or other stamping techniques. Hence, the cavity created with such hollow fin does not necessarily extend over the entire height (i.e. the fin is hollow over only part of the height). Hence, the fins especially have a tubular shape with a cross-section having an aspect ratio larger than 1. Therefore, the fins may have a hollow pipe like structure, with one or both ends closed.

Yet further, such cavity can be empty, but may also be filled with a material, especially a thermally conductive material and especially a light weight material. Hence, in an embodiment the pin-shaped fins are over at least part of their fin height (h) filled with a thermally conductive material. However, the cavity may optionally also be configured as heat pipe. Hence, the hollow part of cavity may at least partly, or entirely be filled with a material other than (only) air or the fin wall material. Alternatively, the fins may be massive, though especially over at least part of the lengths the fins are hollow. In an embodiment, the filler material may e.g. include polystyrene or another polymer material.

Due to the construction of the support and pin-shaped fins, the fins are in general effectively closed at the bottom part (by the support, as the fins are associated to the support). Hence, the fins are herein especially not configured to have the function of a channel through which air may flow.

Hence, the top ends are (also) not necessarily open. So, in some embodiments the top part end is open and from said open top part the fins might be hollow over 50%, 80% or even over 90% of the height of the fin. In other embodiments, the top parts of the pin-shaped fins are closed. This may especially be of relevance for outdoor applications. Such closure may easily be obtained when using metal stamping, as the thus obtained fin may be closed at one part. By arranging the open part to the support, the top part is by definition closed (and, as indicated above, the bottom part is especially closed by the support). Other options to close the fins may however also be used (see also below). Hence, the assembly of the support and the fins may especially lead to tubular fins having a cross-section with an aspect ratio larger than 1 and a cavity within the fins that is closed at one side (bottom part) and optionally also closed at the other side (top part).

The support may be flat, but may optionally also be curved and/or have facets. In general, the support will have a plate like structure with fins arranged at one (optionally curved and/or facetted) side of the support, and with the other side of the support directed to the functional element, such as a light source. Especially the light source and heat sink are in physical contact with each other. For instance, the heat sink may be in contact with an PCB (printed circuit board), or PCB base, comprising a LED, especially a plurality of LEDs.

The term "heat sink" may also refer to a plurality of heat sinks. Hence, the device, especially the lighting device, may comprise a plurality of heat sinks as described herein.

The pin-shaped fins may especially comprise a material selected from the group consisting of aluminum, magnesium, copper, gold, and silver, especially aluminum and/or copper. The fins may comprise aluminum and/or an alloy thereof. Suitable materials may e.g. one or more of aluminum alloys 1051, 6061, 6063, copper, copper-tungsten, diamond, magnesium, magnesium alloy, gold, silver and combinations of two or more of the afore mentioned. Especially, the material comprises one or more metals or metal alloys. However, other high thermal conductive materials (such as metals or alloys) may also be applied. Hence, pin-shaped fins may especially comprise a material selected from the group consisting of alloys comprising one or more of the aforementioned (metal) materials. The fins and the support may comprise the same material. The support may also comprise another material. Especially, the support material comprises one or more of the afore-mentioned high thermal conductive materials or another high thermal conductive material. For instance, the support and fins may consist of aluminum (alloy).

The heat sink comprises a plurality of pin-shaped fins. Especially, the heat sink comprises >>16 fins, such as at least 100 fins, like at least 400 fins. For instance, the heat sink may comprise at least 10 pin-shaped fins per $dm^2$ (1 $dm^2$=100 $cm^2$) support, such as at least 20 pin-shaped fins per $dm^2$ support, like in the range of 10-400 pin-shaped fins per $dm^2$ support.

Especially, the fins are thus not round (in cross-section) but have an elongation or distortion in a single direction (parallel) to the support. For instance, the fins may have an oval cross-section (cross-section in a plane parallel to the heat sink). Other shapes are also possible. In embodiments, the pin-shaped fins have a cross-sectional shape selected from the group consisting of an oval, a rectangle, and a rhombus. Hence, the fins may have a cross-section having a first width (d1) and a second width (d2) having a ratio d1/d2 unequal to 1. Especially, they have cross-sections having a first width (d1) and a second width (d2) having a ratio d1/d2 selected from the range of 1.2-10, such as especially in the range of 1.4-5, such as 1.5-3. This ratio is herein also indicated as aspect ratio (see also above). An aspect ratio for a circle (circular cross-section) would be 1. Especially, the fins have such cross-section with an aspect ratio larger than 1 over substantially the entire height of the fins. However, it is not excluded that over the height the ratio varies. Further, also embodiments are herein included wherein different fins have different aspect ratios. However, substantially all fins will have aspect ratios selected from the herein indicated (aspect) ratios. It appears that with aspect ratios unequal to 1 better thermal dissipation results are obtained than with round fins (aspect ratio 1) or elongated fins (aspect ratio >>10 ("∞")).

With the "distortion" from a circular cross-section, the fins have cross-sections that may include two (perpendicular arranged) axes, with a longer axis and a shorter axis. Both axes are especially parallel to the support. The former is herein indicated as first width axis (and the latter as second width axis). For a good thermal dissipation, it is desirable that the first width axes of the fins are arranged parallel. In this way channels may be formed, through which air may easily flow without substantial friction. The first width axis is especially perpendicular to a length axis of the pin-shaped fin, and especially parallel to the support.

The term "parallel" may also be indicated as "substantially parallel". For instance, parallel may especially indicate that a main axis may be defined (parallel to the support), with the first width axis within an angle of about 15°, especially within an angle of about 10°, even more especially within an angle of about 5° with such main axis. Hence, slight deviations from perfectly parallel may be allowed, as will be clear to a person skilled in the art. Note that there may also be subsections with each having pluralities of pin-shaped fins, wherein within (each) such subsection the first width axes are parallel, but wherein the mutual first width axes of different subsections are not necessarily parallel.

Especially, the heat sink is configured to allow during operation of the lighting device, or other functional device, an air flow flow between the pin-shaped fins in a direction parallel to the first width axes. The person skilled in the art will know how to arrange the heat sink to provide best thermal energy dissipation properties during normal (or intended) use of the (lighting) device. Optionally, the device may further include a fan, or other device, to generate such flow (between the pin-shaped fins in a direction parallel to the first width axes). Further, the heat sink may be arranged with the fins in ambient, and with the support in physical contact with the functional element. Also in this way the heat sink is configured to allow during operation of the lighting device, or other functional device, an air flow flow between the pin-shaped fins in a direction parallel to the first width axes. When the heat sink would be arranged within a unit, the unit may e.g. comprise openings arranged in such a way that during operation of the lighting device, or other functional device, an air flow flow between the pin-shaped fins in a direction parallel to the first width axes.

The fins will in general be arranged in a regular array, though optionally the fins may be arranged irregular. In a specific embodiment, wherein the fins are arranged in a regular array, the plurality of pin-shaped fins are arranged in an array having one or more pitches (p) selected from the range of 1.1*d1-15*d1, especially 1.2*d1-6*d1, more especially 1.5*d1-3*d1. Such dimension may provide a good density of fins on the one hand and a good heat sink surface on the other hand. Different types of regular arrays are possible, such as a cubic (square) arrangement or an hexagonal arrangement (wherein all pitches between nearest neighbors may be identical). Hence, in an embodiment the pin-shaped fins are arranged in a hexagonal array. Combinations of different array types may also be applied.

In a specific embodiment and especially for adding strength to the heat sink, especially for heat sinks with relative long fins (such as over 20 cm, especially over 50 cm), it may be desirable to provide a reinforcing structure at (or close to) the top part of the fins. Hence, in an embodiment the heat sink comprises a support structure associated with the top parts of the plurality of pin-shaped fins. The support structure may in an embodiment be substantially identical to the support at the bottom part of the fins. However, the support structure may also include a wire structure, such as a (metal) gauze, like an aluminum metal gauze. The support structure may also comprise a monolithic body, optionally having high thermal conductivity. The support structure can be associated with the fins with methods known in the art, including soldering, welding, or (simply) physical engagement, such as by clamping or pinching (the support structure to the (top parts of the) fins).

As indicated above, in a further aspect the invention also provides a method of assembling a device comprising a heat generating functional element and a heat sink, the method comprising providing said heat generating functional element and said heat sink and functionally configuring these for dissipation of thermal energy from the heat generating functional element via the heat sink when in operation of the heat generating functional element. Assembling of the heat sink and functional element may be done by methods known in the art, such as soldering, welding, glueing, screwing (engagement), arranging on a same substrate, etc. Especially, the device may comprise a lighting device and the functional element may comprise a light source. During use of the heat generating functional element, the heat sink will dissipate thermal energy thereof, i.e. from the heat generating functional element. Hence, the term "functionally configuring" may in an embodiment refer to configuring these in elements in physical contact with each other, especially the support (at a non-fin side of the support) in physical contact with the functional element, or configuring these in thermal contact with each other. The term "thermal" contact may especially indicate that heat may be transferred from one to another. This may include a heat transferring element or material between the functional element and the heat sink (support).

The lighting device (and heat sink) may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, or LCD backlighting.

Amongst others, the invention may be applied in LED lighting solutions, such as indoor or outdoor floodlight, or road lighting with LED panels.

As indicated above, the lighting unit may be used as backlighting unit in an LCD display device. Hence, the invention provides also a LCD display device comprising the lighting unit as defined herein (and heat sink), configured as backlighting unit. The invention also provides in a further aspect a liquid crystal display device comprising a back lighting unit, wherein the back lighting unit comprises one or more lighting devices as defined herein.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale.

DETAILED DESCRIPTION OF THE EMBODIMENTS

Figure 1A:
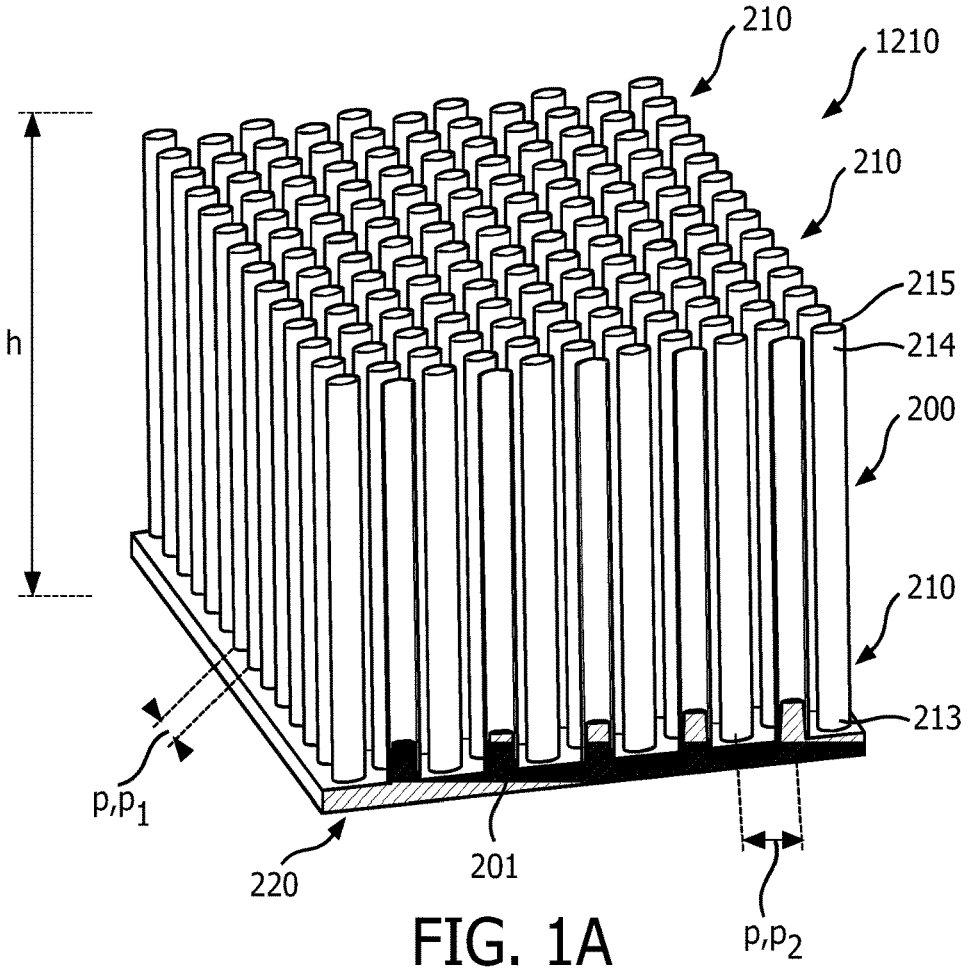
FIGS. 1*a*-1*f* schematically depict some aspects and embodiments of the heat sink.

FIG. 1*a* schematically depicts a heat sink 200 comprising a plurality of pin-shaped fins 210 and a support 220. Both the fins and support may e.g. be of aluminum. The support 220 may especially be a plate-like element. The support may especially have a thickness (or height) in the range of 0.5-50 mm, such as in the range of 2-10 mm. The fins 210 are arranged at one side of the support 220. The other side of the support 220 may be in thermal contact with a functional element (see below).

Each fin 210 has a fin height h relative to the support 220, such as in the range of 1-100 cm. Further, each fin has a bottom part 213 associated with the support 220 and a top part 214. As is visible for the fins shown in cross-section, the pin-shaped fins 210 are hollow over 100% of their fin height h. Hence, the total height of the heat sink is the thickness or height of the support 220 and the height h of the fins 210.

Here, a regular array or pattern 1210 is shown. The fins 210 have thus a pitch p. In the schematically depicted embodiment, the arrangement 1210 is hexagonal. Hence, nearest neighbors may differ in distance or pitch depending upon the direction. In a non-hexagonal arrangement, there may be two different pitches between nearest neighbors (see also FIG. 1*b*). The different pitches are indicated with references p1 and p2. Reference 201 indicates a connector, to associate the fins 210 to the support 220 (see also below). By way of example, the support 220 is drawn flat; however, the support 220 may also be curved and/or include facets (with mutual angles). Reference 215 indicates the fin wall, which is in general relatively thin (compared to the fin height h).

Figure 1B:
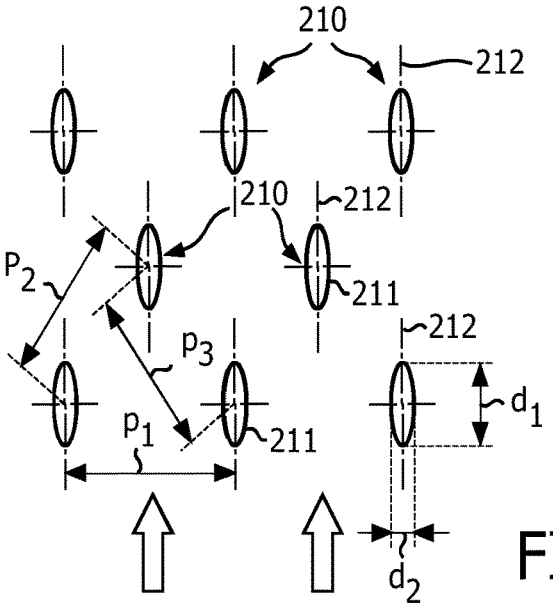

FIG. 1*b* schematically depicts an arrangement, here also a non-hexagonal arrangement, in more detail. A number of pitches p can be discerned; especially the pitches p1 and p2 between nearest neighbors are indicated. Further, a pitch approximately orthogonal to the first pitch p1 is indicated with reference p3. In a substantial hexagonal array p1=p2=p3; in non-hexagonal arrays p1 and p2 may be unequal. Note that with such arrangement, air may flow relatively easily through the channels formed by the fins 210. The fins 210 have a cross-section 211 having a first width d1 and a second width d2 having a ratio d1/d2, especially selected from the range of 1.2-10. Further, the fins 210 have a first width axis 212. The first width axes 212 of the pin-shaped fins 210 are arranged parallel (and parallel to the support (not depicted in 1*b*). Note that also in FIG. 1*a* these first width axes 212 are mutually parallel (and also parallel to (the plane of) the support 220). In a specific embodiment, d1 is in the range of 8-10 mm, d2 is in the range of 3-6 mm, and the pitches p1 and p2 (and p3) are in the range of 10-20 mm.

Figure 1C:
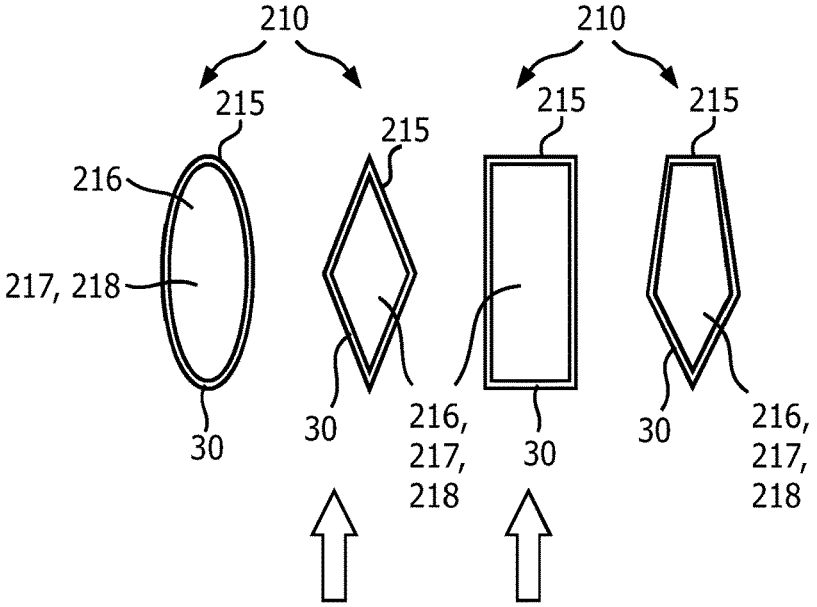

FIG. 1*c* schematically depict some possible shapes of the (hollow) fins 210. The fins 210 have walls 215 which comprise a thermally conductive material 30 ("fin wall material"), such as aluminum or copper (including alloys of aluminum or copper), etc. As the fins 210 are (over at least part of their height) hollow, a cavity 216 is formed. The cross-section thereof is indicated with reference 217 and the cross-sectional area thereof is indicated with reference 218.

Figure 1D:
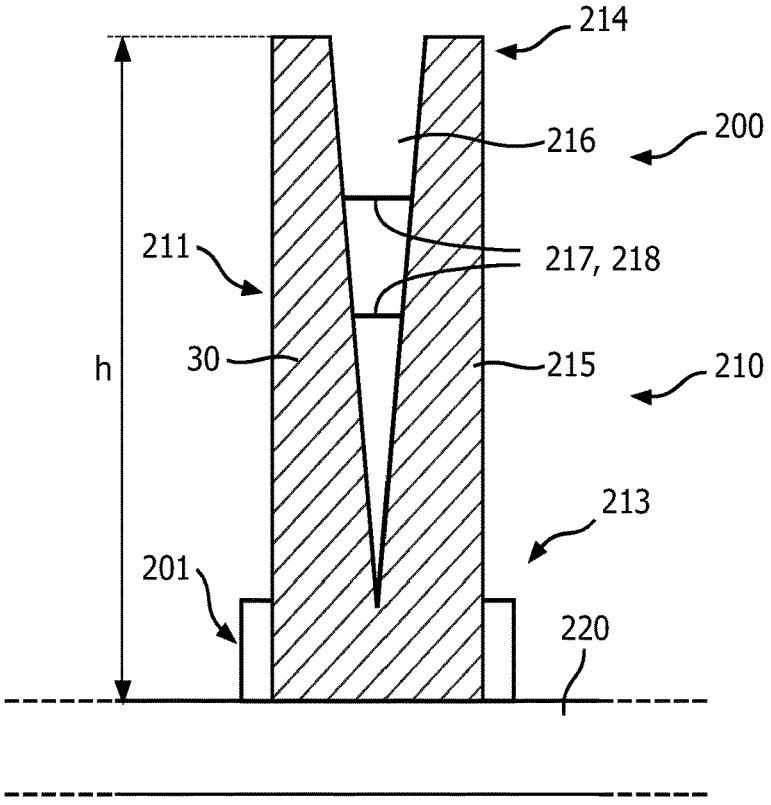

As shown in FIG. 1*d* the cross-sectional area 218 of the cavity may vary over the height h of the fin 210. In this schematic embodiment, the cavity or hollowness extends from the top part 214 over about 65% of the height h. The pin-shaped fin 210 may be arranged in a connector 201. This may be a protruding, extending, or indenting or receding structure on or in the support 220 (see also below). The fin 210 may be clamped therein. The connector 201 may also include a soldering or welding connection, or other type of connection between the support 220 and the bottom part 213 of the pin-shaped fin 210.

Figure 1E:
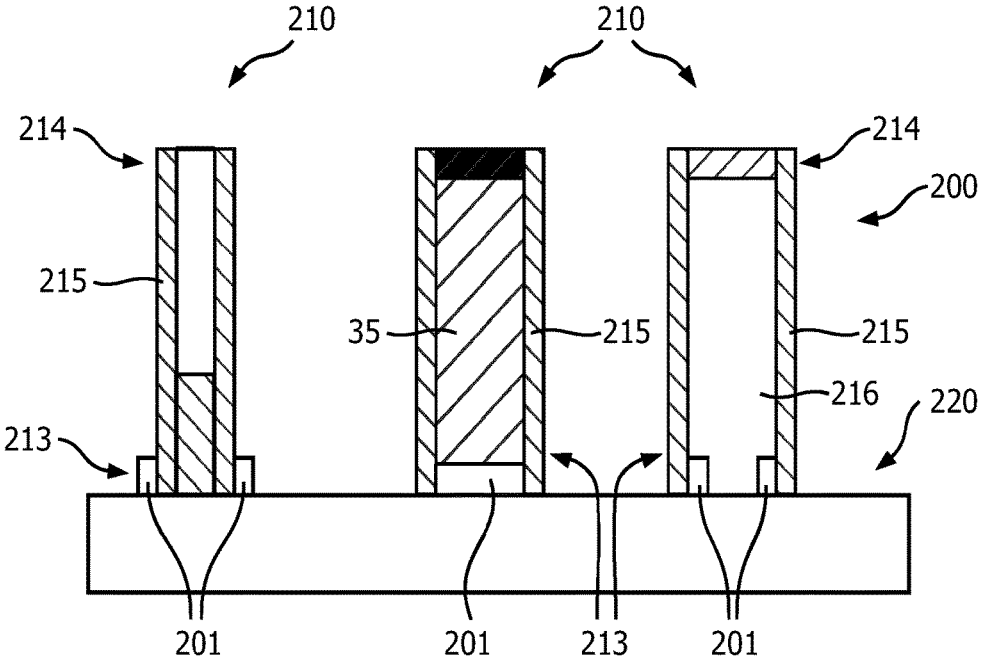

FIG. 1*e* schematically depicts a non-limiting number of options on how, with using connectors 201, the fins 210 may be associated to the support 220. However, other ways to associate the fins to the support 220 may also be possible. The heat sink may be provided as single body or the fins may be soldered or welded to the support, etc. By way of example, the left fin 210 is open at the top part 214 and from there hollow over 100%, whereas the top part of the others is closed. By way of example, the middle pin-shaped fins 210 is (over at least part of the fin height h) filled with a thermally conductive material 35. Starting from the bottom part, the right fin is hollow over about 90% of its height h.

To prevent pollution of the tubes they are either (partially) filled with a low density material like foamed poly styrene or a thermal conductive material, but alternatively or additionally the top may especially be closed. A preferred way to realize a closed top is by forging a tube with a closed bottom and placing it upside down on the base plate. The tubes can be press-fit on a die-cast base plate that has features on it to press-fit the tube on to, in order to get a good thermal and mechanical interconnection. Further robustness of the heat sink can be obtained interconnecting the tubes with a kind of network, or wires, bands or rims (embodiments of the herein indicated support structure, see also FIG. 10.

Figure 1F:
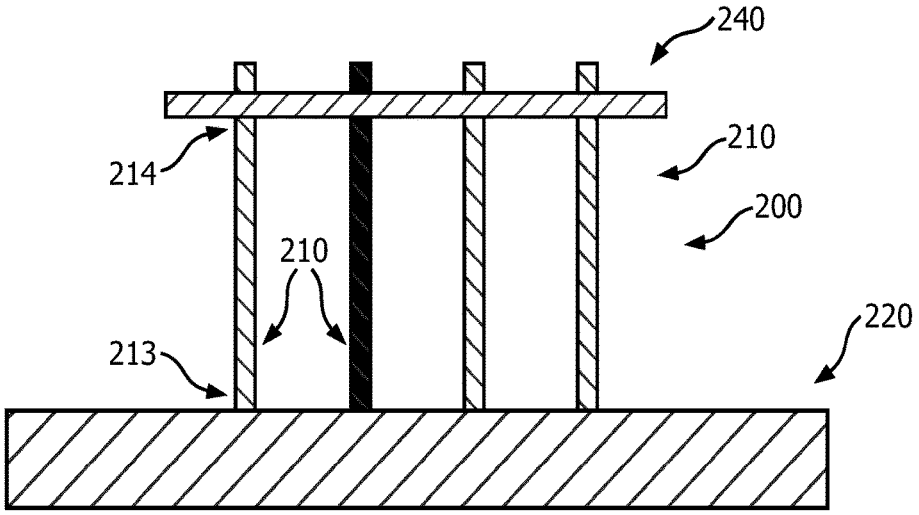

FIG. 1*f* schematically depicts an embodiment of the heat sink 200 further comprising (in addition to the support 220) a support structure 240. This support structure 240 is arranged at the top parts 214. Optionally, part of the fins 210 may extend beyond the support structure 240. However, the top parts 214 may also be embedded in the support structure. Optionally the support structure 240 and the support 220 are substantially identical. Hence, they may also include the same type of materials, or identical materials.

Figure 2A:
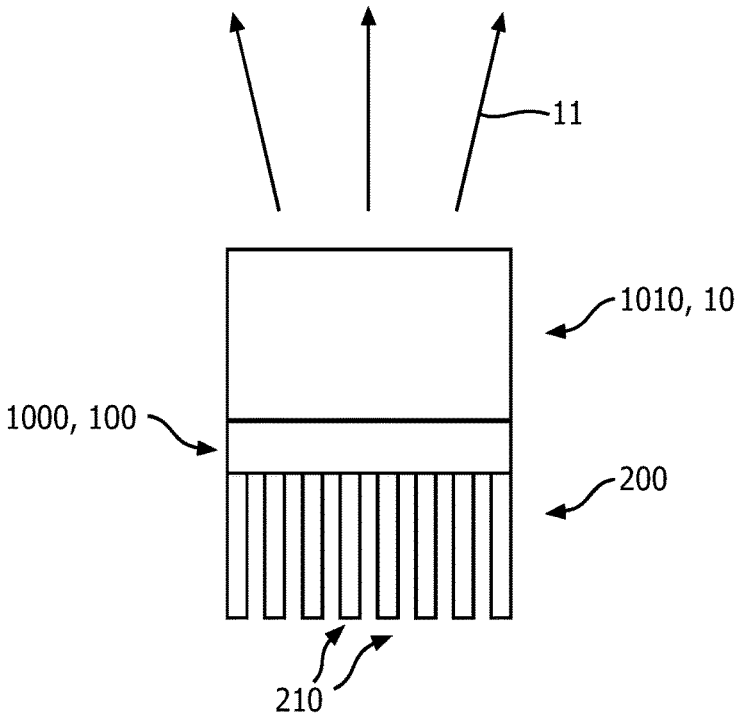
FIGS. 2*a*-2*b* schematically depict some embodiments of a combination of a functional element, such as a light source, and the heat sink.

FIG. 2*a* schematically depicts an embodiment of a device 1000 comprising a heat generating functional element 1010 and the heat sink 200. Here, as example the device 1000 comprises a lighting device 100, and the heat generating functional element 1010 comprises a light source 10. Reference 11 indicates light source light.

Figure 2B:
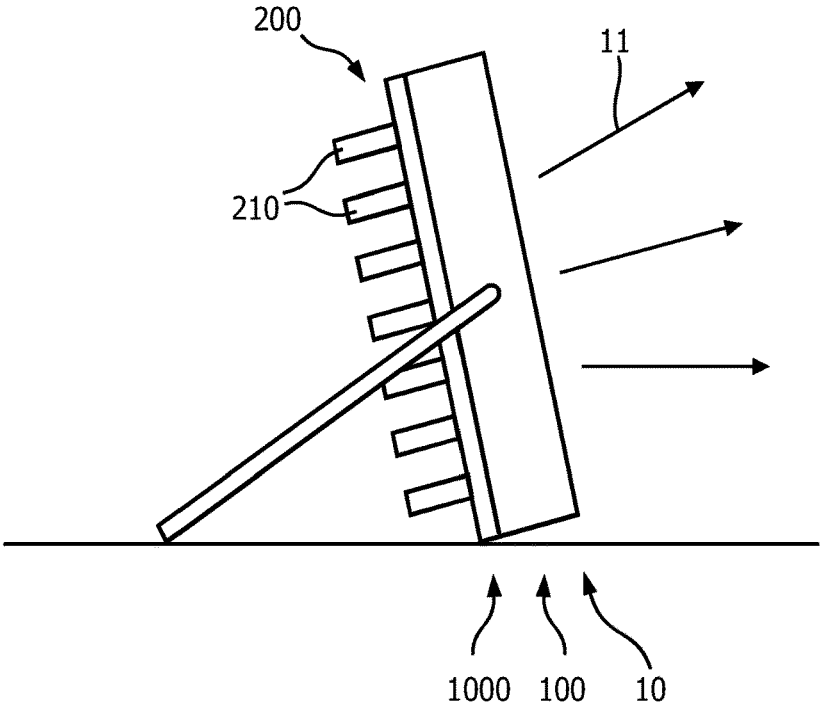

FIG. 2*b* schematically depicts a floodlight as example of the device 1000, especially the lighting device 100. As indicated above, the weight of the heat sink 200 may be considerable. However, with the present invention this weight may also be considerably reduced compared to prior art heat sinks. As shown in FIGS. 2*a* and 2*b*, and also the other figures, the heat sink in these embodiments only comprise fins at one side of the support. Further, in FIGS. 2*a*-2*b* the support (of the heat sink 200) is configured (at a non-fin side) in physical contact with the functional element 1000.

Figure 3A:
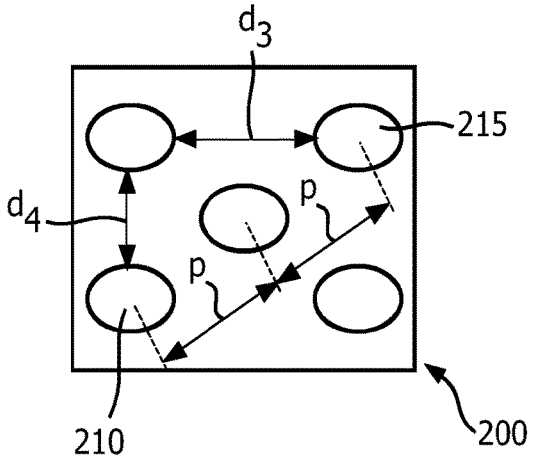
FIGS. 3*a*-3*d* schematically depict some arrangement used in an example.
Figure 3B:
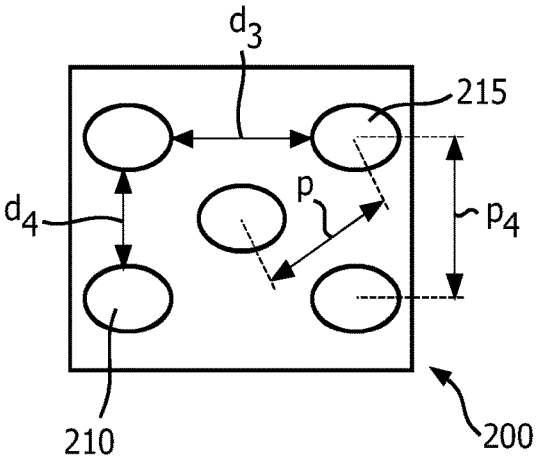
Figure 3C:
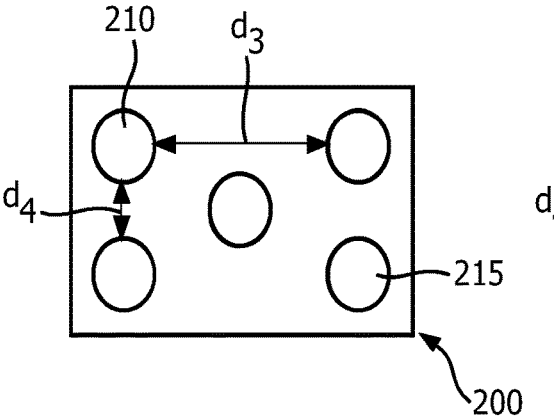
Figure 3D:
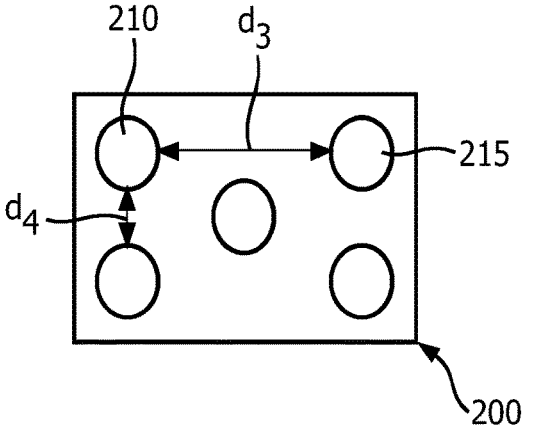

FIG. 3*a*-3*d* (not to scale!) schematically indicate four situations that were used for doing calculations on the thermal properties of the heat sinks FIG. 3*a* shows a situation with elliptical pin fins, 30×11 pins, closed top, fin height 100 mm, base thickness 5 mm, fin wall thickness 0.5 mm, substantially hexagonal arrangement with pitch of 17 mm; d3=12.5 mm and d4=20.45 mm. FIG. 3*b* shows a situation with elliptical pin fins, 34×12 pins, open at the top, fin height 110 mm, base height 4 mm, fin wall thickness 0.8 mm, substantially hexagonal arrangement with a pitch of 15 mm; d3=10.5 mm and d4=17 mm. FIG. 3*c* shows a situation with circular pin fins, 34×12 pins, closed at the top, fin height 100 mm, base height 5 mm, fin wall thickness 0.5 mm, a substantially hexagonal arrangement with a pitch of 15 mm; d3=8 mm and d4=19 mm. FIG. 3*d* shows a situation with circular pin fins, 30×11 pins, open top, fin height 110 mm, base height 4 mm, fin wall thickness 0.5 mm, a substantially hexagonal arrangement with a pitch of 17 mm; d3=10.5 mm and d4=22.45 mm. The pitch p herein indicated is the pitch of the row of three fins 210 starting from below left to top right. Pitch p4 indicates another pitch, which may in a hexagonal arrangement be equal to pitch p. The total surface area which is exposed to a flow is 1: $2.6\times10^{-2}$ $m^2$ (3*a*), $3.1\times10^{-2}$ $m^2$ (3*b*), $2.9\times10^{-2}$ $m^2$ (3*c*) and $2.7\times10^{-2}$ $m^2$ (3*d*).

As boundary conditions, the following conditions were chosen:

- Ambient temperature: 25° C. (298 K);
- Aluminum thermal conductivity: 237 W/mK (default value);
- Radiation included (Heat sink emissivity=0.9);
- Gravity effect included;
- Opening for air at 0 Pa relative pressure;
- Heat flux attached to the bottom surface of fin base (constant for all cases);
- Total heat flux=500 W/85800 $mm^2$=5827.5 $W/m^2$.

The Shear Stress Transport (SST) turbulence model was used.

The results (with reference to FIGS. 3*a*-3*d*) are displayed in the table below:

| | 3a | 3b | 3c | 3d |
|---|---|---|---|---|
| Total Exposed area ($m^2$) | 0.026 | 0.031 | 0.029 | 0.027 |
| Base Area | 0.0028 | 0.0025 | 0.0025 | 0.0028 |
| Max Temperature rise (° C.) | 68 | 70 | 76 | 77 |
| Power (W) (heat flux*Area) | 16.3 | 14.4 | 14.4 | 16.3 |
| Average heat transfer coefficient: pins ($W/m^2K$) | 12.8 | 10.7 | 8.7 | 10.9 |
| Average heat transfer coefficient: Base ($W/m^2K$) | 3.8 | 2.7 | 2.5 | 3 |
| Ave base temperature (° C.) | 90 | 87 | 96 | 98 |
| Thermal resistance (K/W) | 0.13 | 0.12 | 0.14 | 0.15 |
| Mass flow at inlet (kg/s) | $4.8\times10^{-4}$ | $4.1\times10^{-4}$ | $3.3\times10^{-4}$ | $4.1\times10^{-4}$ |
| Temperature rise of air from ambient (° C.) | 34 | 35 | 44 | 35 |
| Width ratio (total model width/section width) | 520/17 | 520/15 | 520/15 | 520/17 |

Then, the thermal resistance of the entire heat sink was evaluated, see below table:

| | 3a | 3b | 3c | 3d |
|---|---|---|---|---|
| No. of fins | 330 | 408 | 408 | 330 |
| One fin area (m2) | 2.21E-03 | 2.41E-03 | 2.24E-03 | 2.21E-03 |
| Total fin area (m2) | 7.29E-01 | 9.83E-01 | 9.12E-01 | 7.28E-01 |

-continued

| | 3a | 3b | 3c | 3d |
|---|---|---|---|---|
| Base area (m2) | 0.0858 | 0.0858 | 0.0858 | 0.0858 |
| Fin efficiency | 0.75 | 0.82 | 0.75 | 0.75 |
| Ave HTC fins (W/m2K) | 12.8 | 10.7 | 8.7 | 10.9 |
| Ave HTC base (W/m2K) | 3.8 | 2.7 | 2.5 | 3 |
| Thermal resistance (K/W) | 0.14 | 0.11 | 0.16 | 0.16 |

The result clearly shows that elliptical pin fins provides better results in terms of maximum temperature and thermal resistance. Further, the flow resistance of the elliptical fins is lower compared to the circular fins. The average heat transfer in the system that may even be further optimized is very high. A higher value could be achieved by optimizing the design more.

Further, thermal calculations have been done on the straight fins of a heat sink of the size that is required for the floodlight example given above. With some assumptions on the material characteristics and the heat transfer coefficient, the total fin weight is around 11 kg and the thermal resistance from fins to ambient is 0.04 K/W. Similar calculations were done with the tube-fin heat sink, in which the pitch between the tubes was set to a preliminary value of 15 mm, and the tube is elliptical in cross section, with 9 mm maximum diameter and 4.5 mm minimum diameter. The tubes are placed in a hexagonal array. Typically 1320 tubes are needed on the 0.52 m×0.495 m base. The thermal resistance (Rth) of the fins to the ambient is expected to be comparable to the straight fin heat sink, about 0.04 K/W, but the fin weight is considerably lower, about 3.6 kg, which is even much lower than 6 kg that is expected for 1 mm fin thickness of the straight fin heat sink.

With the invention, disadvantages of the prior art that are overcome are amongst others:

- the high weight of the finned heat sink;
- the low bending and buckling stiffness of general thin walled elements;
- the high hydraulic resistance of round or hybrid tubular structures placed in an air flow field.

Hence, the invention may include a heat sink base ("support") with rulers, supports, bumps, or holes ("connectors") to attach arrays of tubes to. The base plate may be flat or curved in 1 direction or curved in 2 directions. The tubes have a low wall thickness that are connected to the base plate by e.g. press fit, screwing, soldering, welding or other connection technologies that guarantee a good thermal connection. Further, the tubes are hollow, and have a non-axisymmetric cross-section. Ovals are the first preference, but other hollow rectangular, hexagonal or other multi-angular profiles that are aligned with the expected air flow direction are also possible. Any longitudinal structure with a non-axisymmetric cross section that offer a high bending stiffness and strength while also offering cooling area which can have addition holes or slits, and that are aligned with the expected air flow direction. For instance, forged (oval) tubes that have a (flat) bottom can be are placed upside down on the heat sink base. Optionally, a low density material to fill the hollow tubular structures preventing pollution and giving additional stiffness to the tubes. Optionally a structure to mechanically interconnect the tubes for robustness, which can be combined with the lids mentioned above.

The invention claimed is:

1. A heat sink comprising a plurality of pin-shaped fins and a support, wherein each fin has a fin height relative to the support, a bottom part associated with the support and a top part, a cross-section having a first width (d1) and a second width (d2) having a ratio d1/d2 selected from the range of 1.2-10, and a first width axis, wherein the first width axes of the pin-shaped fins are arranged parallel, and wherein the pin-shaped fins are hollow over at least part of their fin height, wherein each pin-shaped fin comprises a fin wall with the fin wall defining a cavity within the pin-shaped fin having a cavity height, wherein the cavity has a cavity cross-section with a cavity cross-sectional area, wherein over at least part of the cavity height the cavity cross-sectional area reduces in a direction from the top part to the bottom part.

2. The lighting device comprising a light source and a heat sink according to claim 1, wherein the heat sink is configured to dissipate thermal energy from the light source when in operation.

3. The lighting device according to claim 2, wherein the plurality of pin-shaped fins are arranged in an array having one or more pitches selected from the range of 1.2*d1-6*d1.

4. The lighting device according to claim 2, wherein the top parts of the pin-shaped fins are closed.

5. The lighting device according to claim 2, wherein pin-shaped fins have a height in the range of 0.5-100 cm.

6. The lighting device according to claim 2, wherein the heat sink comprises a support structure associated with the top parts of the plurality of pin-shaped fins.

7. The lighting device according to claim 2, wherein the pin-shaped fins are over at least part of their fin height filled with a thermally conductive material.

8. The lighting device according to claim 2, wherein the pin-shaped fins are arranged in a hexagonal array.

9. The lighting device according to claim 2, wherein the lighting device comprises a floodlight.

10. The lighting device according to claim 2, wherein the heat sink is configured to allow during operation of the lighting device an air flow between the pin-shaped fins in a direction parallel to the first width axes.

11. The lighting device according to claim 2, wherein the pin-shaped fins comprise a material selected from the group consisting of aluminum, magnesium, copper, gold, silver, and an alloy comprising one or more of the aforementioned materials.

12. The lighting device according to claim 2, wherein the pin-shaped fins have a cross-sectional shape selected from the group consisting of an oval, a rectangle, and a rhombus.

* * * * *